US006955551B2

(12) United States Patent
Yamamoto

(10) Patent No.: US 6,955,551 B2
(45) Date of Patent: Oct. 18, 2005

(54) CARD EDGE CONNECTOR JIG AND CARD EDGE CONNECTOR CONNECTION MECHANISM

(75) Inventor: Masakazu Yamamoto, Osaka (JP)

(73) Assignee: Espec Corp., Osaka (JP)

( * ) Notice: Subject to any disclaimer, the term of this patent is extended or adjusted under 35 U.S.C. 154(b) by 1 day.

(21) Appl. No.: 10/437,888

(22) Filed: May 15, 2003

(65) Prior Publication Data

US 2004/0014344 A1 Jan. 22, 2004

(30) Foreign Application Priority Data

Jul. 19, 2002 (JP) ..... 2002-211688

(51) Int. Cl.[7] ..... H01R 13/53
(52) U.S. Cl. ..... 439/181; 439/188; 439/924.1
(58) Field of Search ..... 439/181, 188, 439/924.1

(56) References Cited

U.S. PATENT DOCUMENTS

| | | | | |
|---|---|---|---|---|
| 4,681,549 A | * | 7/1987 | Peterson | 439/181 |
| 5,522,738 A | * | 6/1996 | Lace | 439/669 |
| 5,997,327 A | * | 12/1999 | Vergne et al. | 439/181 |
| 6,547,577 B2 | * | 4/2003 | Fujita et al. | 439/188 |

FOREIGN PATENT DOCUMENTS

| | | | |
|---|---|---|---|
| JP | 64-55590 | | 6/1989 |
| JP | 3-126383 | | 5/1991 |
| JP | 05-036455 | | 2/1993 |
| JP | 5-197850 | * | 8/1993 |

* cited by examiner

*Primary Examiner*—Gary Paumen
(74) *Attorney, Agent, or Firm*—Nixon & Vanderhye P.C.; Frank P. Presta

(57) ABSTRACT

The short circuit metal fitting 12 is made to realize such an arrangement that the distance from the contact position of the connection terminals 3 of the electronic circuit board 1 and the short circuit metal fitting 12 in the opening section of the short circuit metal fitting 12 to the contact position of the electronic circuit board 1 and the connector pin 11 of the card edge connector 10 is shorter than the length of the connection terminals 3 in a connection direction and longer than the distance from the contact position of the connector pin 11 and the connection terminals 3 to the back ends of the connection terminals 3 when the electronic circuit board 1 is completely inserted in the card edge connector 10. On this account, it is possible to provide a card edge connector connection jig and a card edge connector connection mechanism capable of preventing breakage of an electronic device etc. due to transient current generated at the time of connection between the electronic circuit board and the card edge connector.

7 Claims, 5 Drawing Sheets

SUBSTARATE IS COMPLETELY INSERTED

SUBSTARATE IS IN CONTACT WITH SHORT CIRCUIT METAL FITTING

SUBSTARATE IS IN CONTACT WITH CONNECTOR PIN

SUBSTARATE IS COMPLETELY INSERTED

CARD EDGE CONNECTOR JIG AND CARD EDGE CONNECTOR CONNECTION MECHANISM

FIELD OF THE INVENTION

The present invention relates to a card edge connector connection jig and a card edge connector connection mechanism capable of preventing breakage of an electronic device etc. due to transient current, which is generated when an electronic circuit board is connected to a card edge connector.

BACKGROUND OF THE INVENTION

In recent years, an electronic device including a large number of electronic circuit components has been used in many different fields.

A general method for assembling such an electronic device is so-called card edge connector connection in which an electronic circuit board including electronic circuit components is connected to an electronic device etc. through a connector. However, in this card edge connector connection, due to contact between metal parts at the time of connection, slight voltage difference occurs between the respective wires, and this difference further generates transient current.

This transient current may cause breakage of electronic devices etc. connected to the connector, and to cope with this problem, various countermeasures against the transient current have been created so as to be provided in the connection section.

FIG. 5 shows a connector connection mechanism as an example of the countermeasures against the transient current. In this mechanism, in both of a electronic circuit board 50, and a card edge connector 60 provided on the electronic device, wirings from connection terminals 53 and 63 are connected to the circuits 51 and 61 for making a short circuit, and the circuits 51 and 61 are further connected to ground via resistors 52 and 62 having a high resistance.

In this connector connection mechanism, when an electronic circuit board 50 is connected to a card edge connector 60 of an electronic device etc., transient current which has been generated due to voltage difference between the wirings connected to the connection terminals 53 and 63 flows into the circuits 51 and 61 connected to ground via the resistors 52 and 62, so as to prevent breakage of an electronic device etc.

Further, similarly, as a countermeasure against static electricity, Japanese Laid-Open Patent Publication Tokukaihei 05-36455/1993 (published on Feb. 12, 1993) discloses a connector connection mechanism of an electronic circuit board in which all of the connection terminals are respectively connected to resistors.

In the connector connection mechanism of an electronic circuit board disclosed in the foregoing publication, adjacent connection terminals of the electronic circuit board have different connection timings since the connection terminals are created to have different lengths from each other. Further, since a resistor having a high resistance is connected to a connection terminal subjected to the first connection, static electricity is discharged by the resistor having a high resistance before the remaining connection terminals are connected, thus preventing breakage of an electronic device etc. due to static electricity.

However, the foregoing conventional connector connection mechanisms of an electronic circuit board used as a countermeasure against transient current or a countermeasure against static electricity is not likely to be capable of completely preventing breakage of an electronic device etc.

Namely, in the foregoing connector connection mechanism of an electronic circuit board, the circuit 61 provided as a countermeasure against transient current or for other purposes is connected to ground via the resistor 62 having a high resistance, and provided not closely but distantly with respect to the connection terminal 63.

In this configuration, the generated transient current mostly flows into the circuit 61, but some of the current, though it will be only a little, still flows into wiring of the electronic device etc. in the card edge connector 60, thus failing to completely prevent breakage of the electronic device etc.

Further, also in the connector connection mechanism of an electronic circuit board used as a countermeasure against transient current disclosed in the foregoing publication, the adjacent connection terminals are made to be different in length so as to provide different connection timings to the adjacent connection terminals. However, this configuration has a problem such that the connector fails to effectively use all poles thereof.

SUMMARY OF THE INVENTION

An object of the present invention is to provide a card edge connector connection jig and a card edge connector connection mechanism capable of preventing breakage of an electronic device etc. due to transient current or static electricity, which are generated at the time of connection of a card edge connector.

In order to attain the foregoing object, a card edge connector connecting jig of the present invention, which is attached to a card edge connector constituting a card edge connector connection mechanism and carries out connection between an electronic circuit board and the card edge connector by inserting the electronic circuit board into the card edge connector, is characterized by comprising an opening section for accepting insertion of the electronic circuit board; the card edge connector connection jig being provided by covering a front end portion of a connector pin included in the card edge connector, and being connected to a resistor connected to ground; a distance from a portion in the opening section where the card edge connector connection jig comes in contact with connection terminals of the electronic circuit board to a portion where the electronic circuit board comes in contact with the connector pin of the card edge connector being shorter than a length of the connection terminals, and longer than the distance from a portion where the connector pin comes in contact with the connection terminals to back ends of the connection terminals in a state where the electronic circuit board is completely inserted in the card edge connector.

With the foregoing arrangement, it is possible to prevent breakage of an electronic device etc. having the card edge connector due to transient current generated at the time of connection between the electronic circuit board and the card edge connector, thereby obtaining a highly-reliable card edge connector connection mechanism.

More specifically, since the card edge connector connection jig of the present invention is connected to a resistor connected to ground, as thus described, it is possible to discharge the transient current generated due to contact between the connection terminals and the card edge connector connection jig when the electronic circuit board is inserted in the opening section of the card edge connector connection jig, via the resistor.

Further, it is also possible to discharge transient current generated when the front ends of the connection terminals come in contact with the connector pin of the card edge connector in the process of inserting the electronic circuit board into the card edge connector, via the resistor.

This effect is provided by a particular configuration of the present invention such that the distance from a portion in the opening section where the card edge connector connection jig comes in contact with connection terminals of the electronic circuit board to a portion where the connection terminals of the electronic circuit board come in contact with the connector pin of the card edge connector is shorter than the length of the connection terminals, and longer than the distance from a portion where the connector pin comes in contact with the connection terminals to the back ends of the connection terminals in a state where the electronic circuit board is completely inserted in the card edge connector.

Namely, when the front ends of the connection terminals of the electronic circuit board come in contact with the connector pin of the card edge connector after passing through the opening section, this contact may cause transient current. At this point, due to the foregoing configuration in which the distance from a portion in the opening section where the card edge connector connection jig comes in contact with connection terminals of the electronic circuit board to a portion where the connection terminals of the electronic circuit board come in contact with the connector pin of the card edge connector is shorter than the length of the connection terminals, the back ends of the connection terminals of the electronic circuit board are still in contact with the card edge connection connector jig.

On this account, it is possible to discharge the transient current generated when the connection terminals of the electronic circuit board come in contact with the connector pin, via the resistor connected to the card edge connector connection jig.

Further, when the electronic circuit board is further inserted and completely connected to the card edge connector, the distance from a portion in the opening section where the card edge connector connection jig comes in contact with connection terminals of the electronic circuit board to a portion where the connection terminals of the electronic circuit board come in contact with the connector pin of the card edge connector is longer than the distance from a portion where the connector pin comes in contact with the connection terminals to the back ends of the connection terminals, and therefore the connection terminals of the electronic circuit board are in contact only with the connector pin.

On this account, the electronic circuit board and the card edge connector are electrically conducted in their connection state, thereby obtaining an appropriate connection state.

As described, the card edge connector connection jig of the present invention is capable of discharging transient current generated when an electronic circuit board is connected to a card edge connector, via a resistor connected to the card edge connector connection jig. Further, when the electronic circuit board is completely connected to the card edge connector, the electronic circuit board and the card edge connector are electrically conducted to each other, thereby obtaining an appropriate connection state. Consequently, it is possible to prevent the problem of breakage of an electronic device etc. having the card edge connector due to transient current, thereby obtaining a highly-reliable card edge connector connection mechanism.

Further, by forming the card edge connector connection jig according to the shape of the electronic circuit board and the card edge connector, it is possible to adopt the jig also for the existing products.

Additional objects, features, and strengths of the present invention will be made clear by the description below. Further, the advantages of the present invention will be evident from the following explanation in reference to the drawings.

DESCRIPTION OF THE EMBODIMENTS

Figure 1:
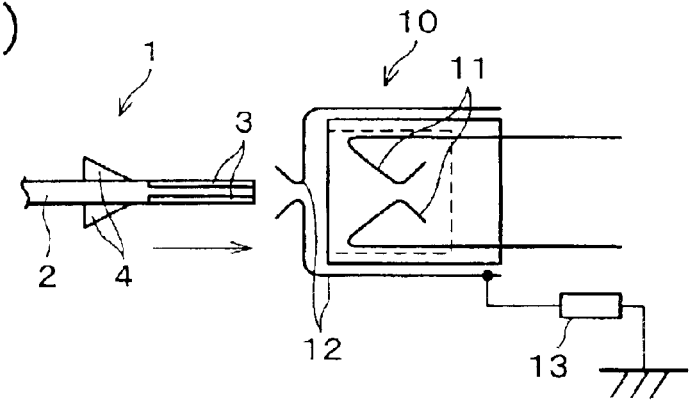
FIGS. 1(*a*) through 1(*d*) are cross-sectional views schematically showing processes for connecting an electronic circuit board and a card edge connector according to one embodiment of a card edge connector connection mechanism of the present invention.
Figure 1:
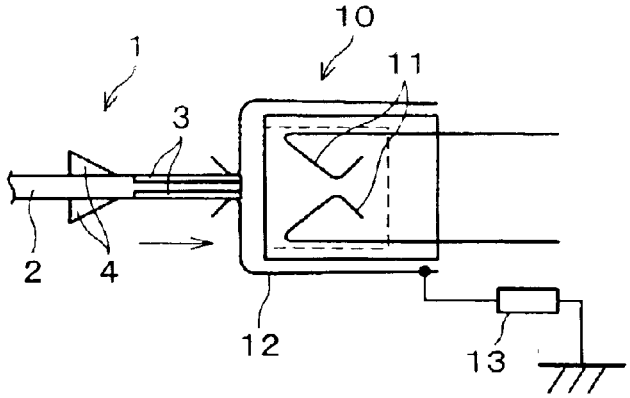
Figure 1:
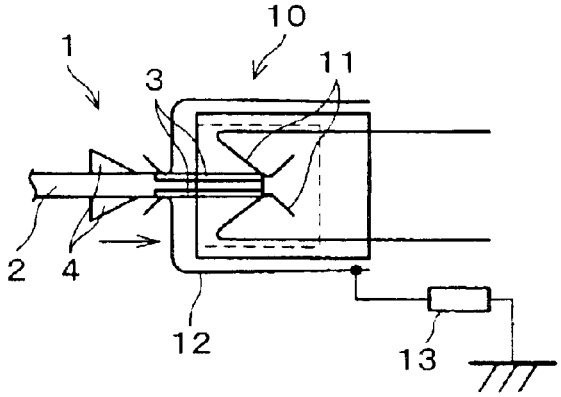
Figure 1:
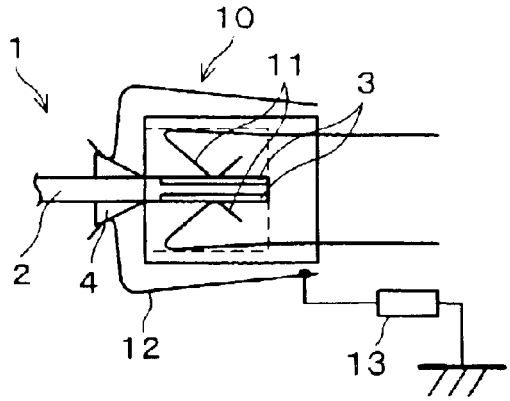

With reference to FIGS. 1(*a*) through 1(*d*), the following will explain one embodiment of a card edge connector connection jig and a card edge connector connection mechanism of the present invention.

Figure 2:
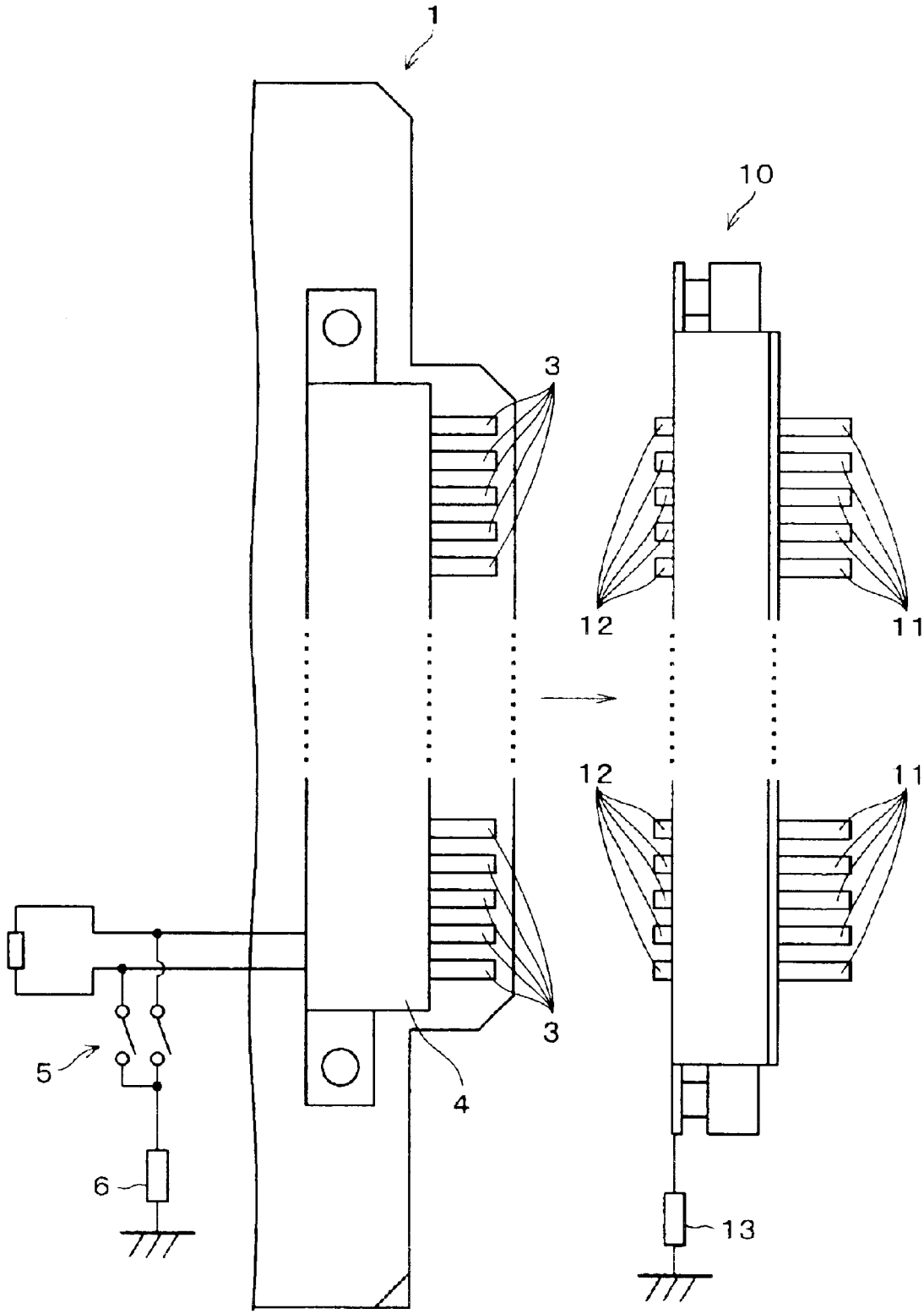
FIG. 2 is a plan view schematically showing the card edge connector and the electronic circuit board shown in FIG. 1.
Figure 3:
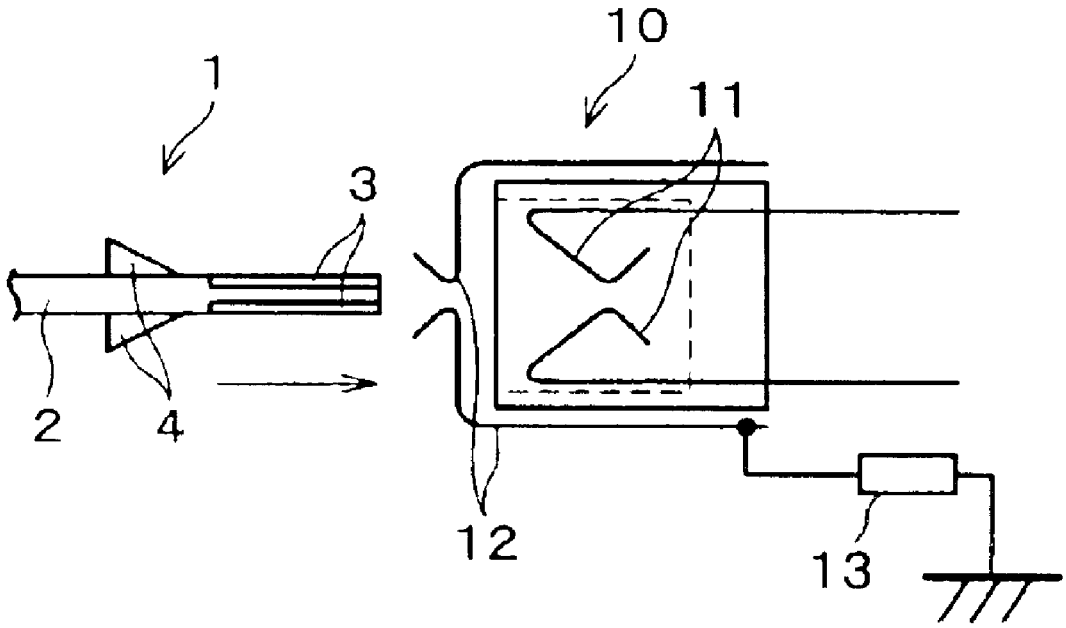
FIG. 3 is a cross-sectional view of the card edge connector and the electronic circuit board shown in FIG. 2 view from the side of them.

As shown in FIGS. 2 and 3, a card edge connector connection mechanism according to the present embodiment includes an electronic circuit board 1 and a card edge connector 10 having a short circuit metal fitting, which is used as a card edge connector connection jig.

As shown in FIG. 3, the electronic circuit board 1 includes a large number of connection terminals 3 and an insulator 4, which both are formed on a substrate 2. Further, as shown in FIG. 2, wirings taken out of the connection terminals 3 are connected to a circuit 5 for making a short circuit, which is connected to a resistor 6 connected to ground.

The insulator 4 is formed on the substrate 2 in a state where the thickness thereof gradually increases from an end having the connection terminals 3. Further, the insulator 4 pushes and spreads a short-circuit metal fitting (a card edge connector connection jig; described later) when the electronic circuit board 1 is connected to the card edge connector 10. Further, the insulator 4 operates to cut off the contact between the connection terminals 3 and the short circuit metal fitting 12 when the electronic circuit board 1 is completely inserted into the card edge connector 10.

The circuit 5 and the resistor 6 are provided as countermeasures against transient current, which is generated when the connection terminals 3 come in contact with a metal, such as a connector pin 11 or the short circuit metal fitting 12. More specifically, in case of generation of transient current, the transient current flows into the circuit 5 and then is discharged via the resistor 6 connected to ground.

Meanwhile, as shown in FIGS. 2 and 3, the card edge connector 10 includes the connector pin 11, the short circuit metal fitting 12, and a resistor 13 connected to the short circuit metal fitting 12.

The connector pin 11 is made up of two conductive thin plates, and the respective ends of the plates are bent toward inside, i.e., in the opposite directions, so as to have an interval slightly narrower than the thickness of the electronic circuit board 1. Further, the connector pin 11 is covered with the short circuit metal fitting 12 in an end to which the electronic circuit board 1 is connected.

Similar to the connector pin 11, the short circuit metal fitting 12 is made up of two conductive thin plates whose surfaces are gold-plated. Further, the respective ends on connection side are bent at a right angle, and the edges are further bent in a state where the interval between the thin plates gradually become narrower from the side of the electronic circuit board 1, while keeping the interval slightly thinner than the thickness of the electronic circuit board 1, so as to ease the insertion of the electronic circuit board 1. Further, the short circuit metal fitting 12 is connected to ground with the ends opposite to the connection side, via the resistor 13.

The resistor 13 has a high resistance of 1MΩ or greater, and therefore, even in case of generation of transient current or static electricity, the resistor is capable of slowing discharging the current to ground.

Note that, when the electronic circuit board 1 is inserted, the connector pin 11 and the short circuit metal fitting 12 extend the intervals between the two thin plates having spring-characteristic, and the electronic circuit board 1 is connected to the card edge connector 10 in this state.

The card edge connector connection mechanism according to the present invention realizes both discharge of transient current and connection between the electronic circuit board 1 and the card edge connector 10, by establishing or canceling the contact between the connection terminals 3, and the short circuit metal fitting 12 or the connector pin 11, at the time of insertion of the electronic circuit board 1 into the card edge connector 10.

Further, this establishment and cancellation of the contact can be realized by specifying the distance of the contact position between the connection terminals 3, with respect to the short circuit metal fitting 12 and the connector pin 11.

More specifically, the short circuit metal fitting 12 is made to realize such an arrangement that the distance from the contact position of the connection terminals 3 of the electronic circuit board 1 and the short circuit metal fitting 12 in the opening section of the short circuit metal fitting 12 to the contact position of the electronic circuit board 1 and the connector pin 11 of the card edge connector 10 is shorter than the length of the connection terminals 3 in a connection direction, and longer than the distance from the contact position of the connector pin 11 and the connection terminals 3 to the back ends of the connection terminals 3 when the electronic circuit board 1 is completely inserted in the card edge connector 10.

Note that, in the card edge connector connection mechanism of the present embodiment, the insulator 4 is provided on a portion of the substrate near the back ends of the connection terminals 3, as shown in FIGS. 1(*a*) through 1(*d*). Note that, in case where the insulator 4 is formed on the connection terminals 3 so that the short circuit metal fitting 12 and the connection terminals 3 are not in contact with each other when the electronic circuit board 1 is completely inserted in the card edge connector 10, the foregoing distance from the contact position of the connector pin 11 and the connection terminals 3 to the back ends of the connection terminals 3 does not need to be taken into account.

Here, with reference to FIGS. 1(*a*) through 1(*d*), the following will explain the steps for connecting the electronic circuit board 1 into the card edge connector 10 by using the card edge connector connection mechanism described above.

Firstly, for connecting the electronic circuit board 1 to the card edge connector 10, the top end of the electronic circuit board 1 is inserted in the gap between the two thin plates constituting the short circuit metal fitting 12, as shown in FIG. 1(*a*).

When the electronic circuit board 1 pushes and spreads the gap between the two thin plates constituting the short circuit metal fitting 12 so that the connection terminals 3 of the electronic circuit board 1 come in contact with the short circuit metal fitting 12, as shown in FIG. 1(*b*), transient current may be generated due to the contact of the metals.

However, as described, since an end of the short circuit metal fitting 12 is connected to ground via the resistor 13, it is possible to discharge all of the transient current thus generated.

Further, when the electronic circuit board 1 is further inserted into the card edge connector 10 as shown in FIG. 1(*c*), the connection terminals 3 come in contact with the connector pin 11. Here, since the short circuit metal fitting 12 is formed to maintain the foregoing distance relation, the connection terminals 3 are in contact with both the connector pin 11 and the short circuit metal fitting 12 at the same time. Namely, since the distance from the contact position of the connection terminals 3 of the electronic circuit board 1 and the short circuit metal fitting 12 in the opening section of the short circuit metal fitting 12 to the contact position of the electronic circuit board 1 and the connector pin 11 of the card edge connector 10 is shorter than the length of the connection terminals 3 in a connection direction, even when transient current is generated at the time of contact of the connection terminals 3 and the connector pin 11, it is possible to discharge the transient current via the resistor 13 connected to the short circuit metal fitting 12.

Lastly, when the electronic circuit board 1 is in a connection state by being completely inserted in the card edge connector 10 as shown in FIG. 1(*d*), the connection terminals 3 and the short circuit metal fitting 12 are not in contact with each other. At this stage, the short circuit metal fitting 12 is in contact with the insulator 4 formed on the electronic circuit board 1, while being spread by the insulator 4. Here, the connection terminals 3 of the electronic circuit board 1 are only in contact with the connector pin 11, and they are electrically conducted.

As described, the card edge connector connection mechanism of the present embodiment is provided by covering an end on the connection side of the card edge connector 10, and includes the short circuit metal fitting 12 which is connected to the resistor 13 connected to ground. With this configuration, even when transient current is generated at the time of connection between the electronic circuit board 1 and the card edge connector 10, it is possible to discharge the transient current via the resistor 13 connected to ground. Consequently, it is possible to effectively prevent breakage of an electronic device etc. having the card edge connector 10 due to the transient current, thereby obtaining a highly-reliable card edge connector connection mechanism.

Further, the card edge connector 10 is not required to include a circuit for making a short circuit, which is conventionally used as a conventional countermeasure against transient current or static electricity, thereby preventing the problem of transient current with a simpler configuration.

Note that, the present embodiment describes a concrete example for showing characteristics of the card edge connector connection mechanism of the present invention; however, the present invention is not limited to the content of the explanation made in the present embodiment.

Also, the present invention does not limit the bending state of the end portions of the connector pin 11 and the short circuit metal fitting 12 to the ones described in this embodiment, and any states may be adopted as long as they can provide an arrangement with the described discharging function of the transient current at the time of insertion of the electronic circuit board 1. Similarly, there is no limitation with respect to the shape of the insulator 4.

Figure 4:
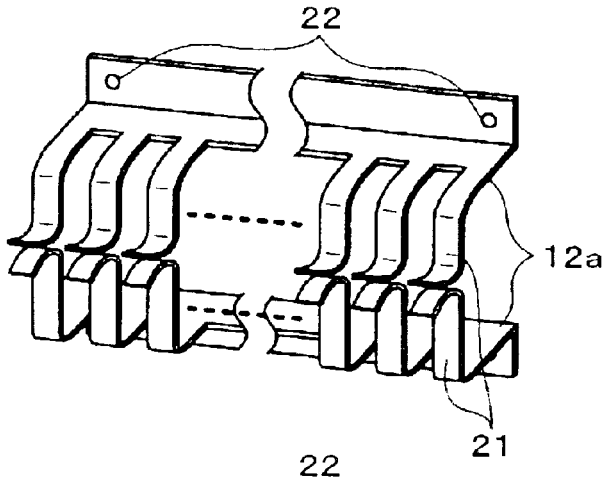
FIGS. 4(*a*) through 4(*d*) are perspective views showing examples of the shape of a card edge connector connection jig according to the present invention.
Figure 4:
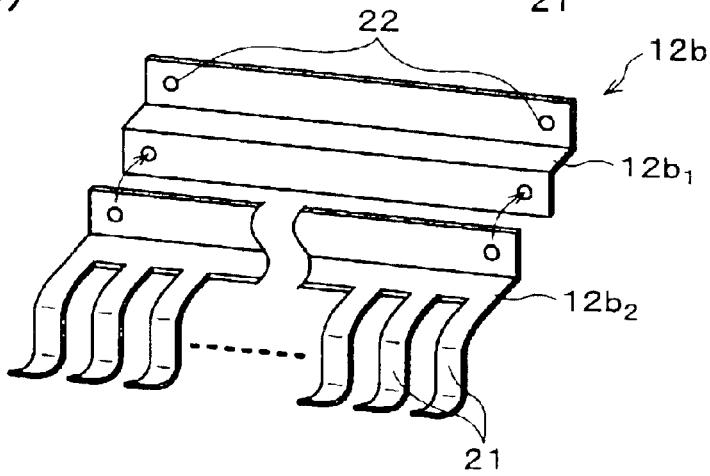
Figure 4:
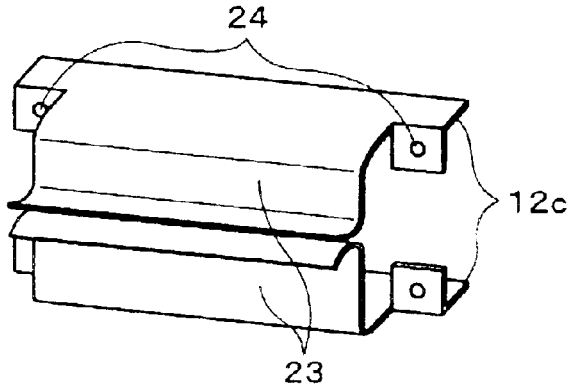
Figure 4:
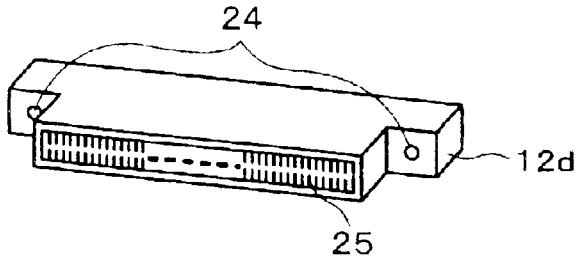
Figure 5:
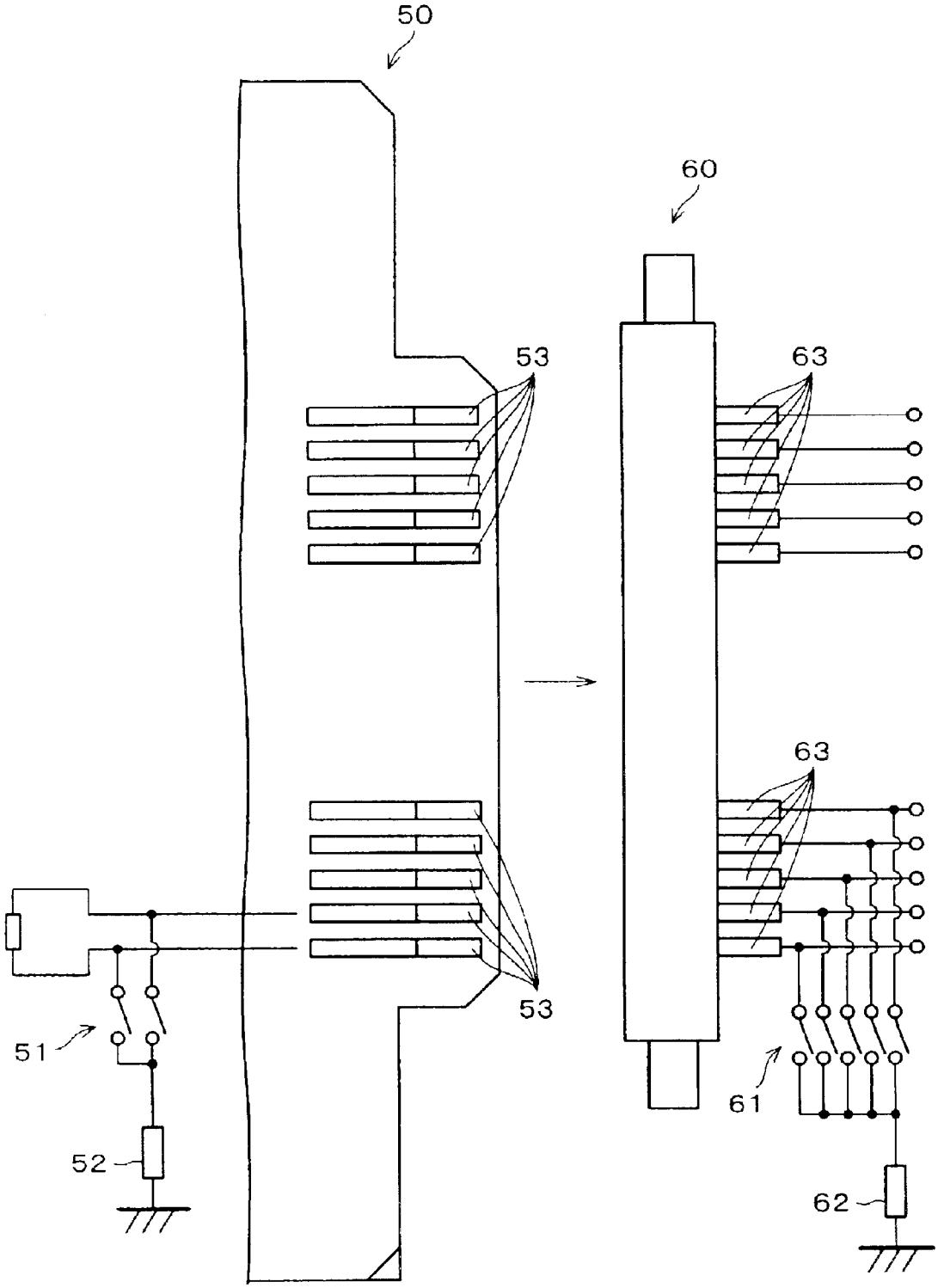
FIG. 5 is a plan view showing connection between a conventional card edge connector and an electronic circuit board.

For example, the short circuit metal fitting 12 may have the shapes shown in FIGS. 4(*a*) through 4(*d*).

The short circuit metal fitting 12*a* shown in FIG. 4(*a*) has front ends 21 which are formed with predetermined intervals so as to be individually contacted to each of the connection terminals 3 of the electronic circuit board 1. On this account, each of the connection terminals 3 are unfailingly comes in contact with the corresponding front end 21, and therefore, even in case of generation of transient current, the current flows into ground via the short circuit metal fitting 12*a*, thus preventing breakage of the electronic circuit board 1 etc. due to the transient current.

Note that, instead of the short circuit metal fitting 12*a*, the short circuit metal fitting 12*b* shown in FIG. 4(*b*) may also be used. The short circuit metal fitting 12*b* can be divided into an attachment section $12b_1$ having attachment holes 22, and a separation section $12b_2$ having front ends 21. This example includes removable front ends 21 which are separately formed. By forming the front ends 21 according to the plural types of substrates having different intervals between the respective connection terminals 3, it is possible to make connection with respect to all types of the electronic circuit board 1 regardless of the pitch between the connection terminals 3. Further, this arrangement can provide an effect in case of degradation of the front ends, such that it is not necessary to connect the short circuit metal fitting again to ground, as only the front ends need to be replaced.

Further, the short circuit metal fittings 12*a* through 12*c* shown in FIGS. 4(*a*) through 4(*c*) may be manufactured to have a long length in the width direction so as to be used by cutting the width according to the width of the target connector. On this account, these metal fittings ensure high versatility.

Further, as with the front ends 23 shown in FIG. 4(*c*), the front ends 23 may be formed by a single plate. On this account, since the front ends 23 can be in contact with all of the connection terminals 3 regardless of the pitch between the connection terminals 3, they can be adopted for connection of the electronic circuit board 1 having a different pitch between the connection terminals 3.

Further, as with the front ends 25 shown in FIG. 4(*d*), the front ends may be formed by a thin metal of brush-shaped or probe-shaped or the like. On this account, even in case of making connection with the electronic circuit board 1 having a different pitch between the connection terminals 3, the front end of the brush etc. are unfailingly in contact with each of the connection terminals 3, and therefore it is possible to make connection with plural types of substrate having different pitches between the connection terminals 3. Further, it is not necessary to change the whole body of the short circuit metal fitting even in case of degradation of the front ends 25, as only the brush etc. needs to be replaced.

Further, the short circuit metal fitting 12 may be attached to a wall of the electronic device etc. through the attachment holes 22 as shown in FIGS. 4(*a*) and 4(*b*); or may be otherwise directly attached to the card edge connector 10 through the attachment holes 24 as shown in FIGS. 4(*c*) and 4(*d*).

Note that, each relation between the attachment hole and the shape of the short circuit metal fitting shown in FIGS. 4(*a*) through 4(*d*) are only examples, and the present invention is not limited to these combinations. For example, the short circuit metal fitting 12*a* shown in FIG. 4(*a*) may have the attachment hole 24 to be directly attached to the card edge connector 10. Further, the short circuit metal fittings 12*c* and 12*d* shown in FIGS. 4(*c*) and 4(*d*) may respectively have the attachment hole 22 to be attached to a wall of an electronic device etc.

Further, the described short circuit metal fitting 12 may be manufactured in a shape appropriate for the shape of the target electronic circuit board 1 and the card edge connector 10 so as to be adopted for the existing products.

Further, the insulator 4 is not always required, since the configuration is only aimed at preventing the contact between the connection terminals 3 and the short circuit metal fitting 12 so as to cancel the conduction to ground, when the electronic circuit board 1 is completely inserted in the card edge connector 10. However, as with the present embodiment, by having the insulator 4 on a portion on the electronic circuit board 1 caught between the short circuit metal fitting 12 when the electronic circuit board 1 is completely inserted in the card edge connector 10, it is possible to entirely block the contact between the connection terminals 3 and the short circuit metal fitting 12, thus providing a more preferable effect.

Further, the card edge connector connection mechanism of the present invention may be adopted as a connection mechanism for carrying out all connection of the card edge connector including such as connection with a test board in an evaluation test device.

Further, the card edge connector connection mechanism of the present invention may be a card edge connector connection mechanism for establishing electrical contact between a test board and a card edge connector, the mechanism being characterized by including a function for being connected to ground via a resistor having a high resistance in the vicinity of the contact portion of the test board and the card edge connector wherein the function for being connected to ground is cancelled when the board is completely inserted.

Further, the card edge connector connection jig of the present invention used in a card edge connector connection mechanism for carrying out connection between an electronic circuit board and a card edge connector is characterized by comprising an opening section for accepting insertion of the electronic circuit board, the card edge connector connection jig being provided by covering a front end portion of the connector pin included in the card edge connector, and being connected to a resistor connected to ground; the card edge connector connection jig being in contact with the connection terminals in a process of inserting the electronic circuit board into the card edge connector through the opening section before the electronic circuit board comes in contact with the connector pin of the card edge connector after passing through the opening section, and being not in contact with the connection terminals when the electronic circuit board is completely inserted in the card edge connector.

Further, the card edge connector connection mechanism of the present invention for carrying out connection between connection terminals of an electronic circuit board and a card edge connector by inserting the electronic circuit board into the card edge connector is characterized by comprising: an electronic circuit board having a plurality of connection terminals, a card edge connector having a connector pin, and a card edge connector connection jig having an opening section for accepting insertion of the electronic circuit board; the card edge connector connection jig being provided on a connection side of the card edge connector by covering a connection section of the connector pin of the card edge connector, and being connected to a resistor connected to ground; the connection terminals and the connector pin being in contact with each other when the electronic circuit board is inserted in the card edge connector, and the connection terminals being in contact with the card edge connector connection jig in a process of inserting the electronic circuit board into the card edge connector, and being not in contact with the card edge connector connection jig when the electronic circuit board is completely inserted in the card edge connector.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A card edge connector connection jig, attached to a card edge connector constituting a card edge connector connection mechanism which carries out connection between an electronic circuit board and the card edge connector by inserting the electronic circuit board into the card edge connector, comprising:

an opening section for accepting insertion of the electronic circuit board, the card edge connector connection jig covering a front end portion of a connector pin included in the card edge connector, and being connected to a resistor connected to ground, a distance from a portion in the opening section where the card edge connector connection jig comes in contact with connection terminals of the electronic circuit board to a portion where the electronic circuit board comes in contact with the connector pin of the card edge connector being shorter than a length of the connection terminals, and longer than the distance from a portion where the connector pin comes in contact with the connection terminals to back ends of the connection terminals in a state where the electronic circuit board is completely inserted in the card edge connector.

2. The card edge connector connection jig as set forth in claim 1, wherein:

the resistor connected to ground has a resistance of not less than 1MΩ.

3. A card edge connector connection mechanism for carrying out connection between an electronic circuit board and a card edge connector by inserting the electronic circuit board into the card edge connector, comprising:

an electronic circuit board having a plurality of connection terminals;

a card edge connector having connector pins to be electrically conducted to the connection terminals of the electronic circuit board; and a card edge connector connection jig having an opening section for accepting insertion of the electronic circuit board, and covering a connection section of the connector pin with respect to the electronic circuit board, the card edge connector connection jig being connected to a resistor connected to ground, wherein:

a distance from a portion in the opening section where the card edge connector connection jig comes in contact with the connection terminals of the electronic circuit board to a portion where the electronic circuit board comes in contact with the connector pin of the card edge connector is shorter than a length of the connection terminals, and longer than the distance from a portion where the connector pin comes in contact with the connection terminals to back ends of the connection terminals in a state where the electronic circuit board is completely inserted in the card edge connector.

4. The card edge connector connection mechanism as set forth in claim 3, wherein:

the electronic circuit board includes an insulator on a portion in contact with the connector pin when the electronic circuit board is completely inserted in the card edge connector.

5. A card edge connector connection jig used in a card edge connection mechanism which carries out connection between an electronic circuit board and a card edge connector, comprising:

an opening section for accepting insertion of the electronic circuit board, the card edge connector connection jig covering a front end portion of a connector pin included in the card edge connector, and being connected to a resistor connected to ground, the card edge connector connection jig being in contact with the connection terminals in a process of inserting the electronic circuit board into the card edge connector through the opening section before the connection terminals of the electronic circuit board come in contact with the connector pin of the card edge connector after passing through the opening section, and being not in contact with the connection terminals when the electronic circuit board is completely inserted in the card edge connector.

6. A card edge connector connection mechanism, wherein:

the mechanism electrically connects an electronic circuit board and a card edge connector; and connection terminals of the electronic circuit board come in contact with a card edge connector connection jig, which is connected to ground via a resistor having a high resistance, before coming in contact with the card edge connector; and when the electronic circuit board is completely inserted in the card edge connector, the connection terminals of the electronic circuit board are released from the grounded state.

7. A card edge connector connection mechanism for carrying out connection between connection terminals of an electronic circuit board and a card edge connector by inserting the electronic circuit board into the card edge connector, comprising:

an electronic circuit board having a plurality of connection terminals;

a card edge connector having a connector pin; and a card edge connector connection jig having an opening section for accepting insertion of the electronic circuit board, the card edge connector connection jig being on a connection side of the card edge connector and covering a connection section of the connector pin with respect to the electronic circuit board, and being connected to a resistor connected to ground, the connection terminals of the electronic circuit board being in contact with the card edge connector connection jig in a process of inserting the electronic circuit board into the card edge connector, and not being in contact with the card edge connector connection jig when the electronic circuit board is completely inserted in the card edge connector.

* * * * *